US009523294B2

(12) United States Patent
Cho

(10) Patent No.: US 9,523,294 B2
(45) Date of Patent: Dec. 20, 2016

(54) VALVE DRIVING DEVICE USING PIEZOELECTRIC ACTUATOR

(71) Applicant: HYUNDAI MOTOR COMPANY, Seoul (KR)

(72) Inventor: Jin Hee Cho, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 118 days.

(21) Appl. No.: 14/522,179

(22) Filed: Oct. 23, 2014

(65) Prior Publication Data

US 2015/0322829 A1 Nov. 12, 2015

(30) Foreign Application Priority Data

May 12, 2014 (KR) ..... 10-2014-0056559

(51) Int. Cl.
*F01L 1/18* (2006.01)
*F01L 9/04* (2006.01)

(52) U.S. Cl.
CPC ..... *F01L 9/04* (2013.01); *F01L 2009/0401* (2013.01); *F01L 2009/0413* (2013.01); *F01L 2009/0432* (2013.01)

(58) Field of Classification Search
CPC ..... F01L 9/04; F01L 2009/0401; F01L 2009/0413; F01L 2009/0432
USPC ..... 123/90.11, 90.39, 90.44
See application file for complete search history.

(56) References Cited

U.S. PATENT DOCUMENTS

| | | | | |
|---|---|---|---|---|
| 4,952,835 | A | 8/1990 | Stahlhuth | |
| 6,294,859 | B1 * | 9/2001 | Jaenker | H02N 2/043 310/328 |
| 6,477,997 | B1 * | 11/2002 | Wakeman | F01L 13/0005 123/198 F |

FOREIGN PATENT DOCUMENTS

| | | | |
|---|---|---|---|
| JP | 2007-056777 | A | 3/2007 |
| JP | 2011-226331 | A | 11/2011 |
| KR | 10-1991-0000671 | | 1/1991 |
| KR | 1996-0038047 | A | 11/1996 |
| KR | 2009-0043283 | A | 5/2009 |

* cited by examiner

*Primary Examiner* — Ching Chang
(74) *Attorney, Agent, or Firm* — McDermott Will & Emery LLP

(57) ABSTRACT

A valve driving device using a piezoelectric actuator includes a piezoelectric body of which a volume expands according to a voltage applied thereto. A displacement increase housing amplifies the volume expansion of the piezoelectric body. A swing arm is connected to the displacement increase housing and operated to drive an engine valve according to the amplified expansion of the piezoelectric body.

11 Claims, 9 Drawing Sheets

VALVE DRIVING DEVICE USING PIEZOELECTRIC ACTUATOR

CROSS-REFERENCE TO RELATED APPLICATION

This application claims the benefit of priority to Korean Patent Application No. 10-2014-0056559 filed in the Korean Intellectual Property Office on May 12, 2014, the entire contents of which are incorporated herein by reference.

TECHNICAL FIELD

The present disclosure relates to a valve driving device, and more particularly, to a valve driving device using a piezoelectric actuator.

BACKGROUND

In general, an intake/exhaust valve opening/closing driving device of a vehicle engine operates an intake/exhaust valve by rotating a cam in response to each valve opening/closing using a timing belt. The cam is in contact with the intake/exhaust valve opening/closing driving device and rotates by driving a cam pulley connected with a crank pulley.

For the intake/exhaust valve opening/closing driving device, an opening/closing time adjusting device has been used to variably adjust the opening/closing time based on a changed load condition of a vehicle combustion engine determined by an electronic control unit (ECU).

However, the intake/exhaust valve opening/closing driving device in the related art has a complex mechanical design, and thus has a limit in decreasing the weight of the engine. Particularly, since the intake/exhaust valve opening/closing driving device has a complex connection between the mechanisms, the adjustment of an opening/closing time according to a load condition is not accurate.

A technology in which a magnetic field is formed to drive a valve by applying a voltage to a coil without a cam has been developed. However, according to this technology, a current flows when the valve is opened, so that heat is generated in the coil, thereby consuming considerate energy.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a valve driving device using a piezoelectric actuator which is capable of opening/closing an engine valve by using an expansion volume of the piezoelectric actuator according to an applied voltage and amplifying the expansion of the piezoelectric actuator by a vertical displacement increase structure and a swing arm.

According to an exemplary embodiment of the present inventive concept, a valve driving device using a piezoelectric actuator, includes a piezoelectric body of which a volume expands according to a voltage applied thereto. A displacement increase housing amplifies the expansion of the piezoelectric body. A swing arm is connected to the displacement increase housing and operated to drive an engine valve according to the amplified expansion of the piezoelectric body.

The piezoelectric body may be formed by stacking a plurality of piezoelectric devices and serves as the piezoelectric actuator.

The displacement increase housing perpendicularly expands or contracts with respect to an expansion direction of the piezoelectric body.

The displacement increase housing may expand in association with the expansion of the piezoelectric body.

The displacement increase housing may contract when the piezoelectric body expands.

The displacement increase housing may be provided with a dual frame.

The dual frame of the displacement increase housing may be operated by a dual hinge.

The displacement increase housing may include a preload spring which restricts the piezoelectric body.

As described above, according to the exemplary embodiment of the present inventive concept, the engine valve is driven by using an expanded volume of the piezoelectric actuator according to a voltage applied thereto. The engine valve is opened/closed by amplifying the expansion of the piezoelectric actuator with the displacement increase housing and the swing arm, thereby improving fuel efficiency and output, reducing exhausted gas, decreasing the number of engine components, and reducing material cost and weight.

DETAILED DESCRIPTION OF THE EMBODIMENTS

Figure 1:
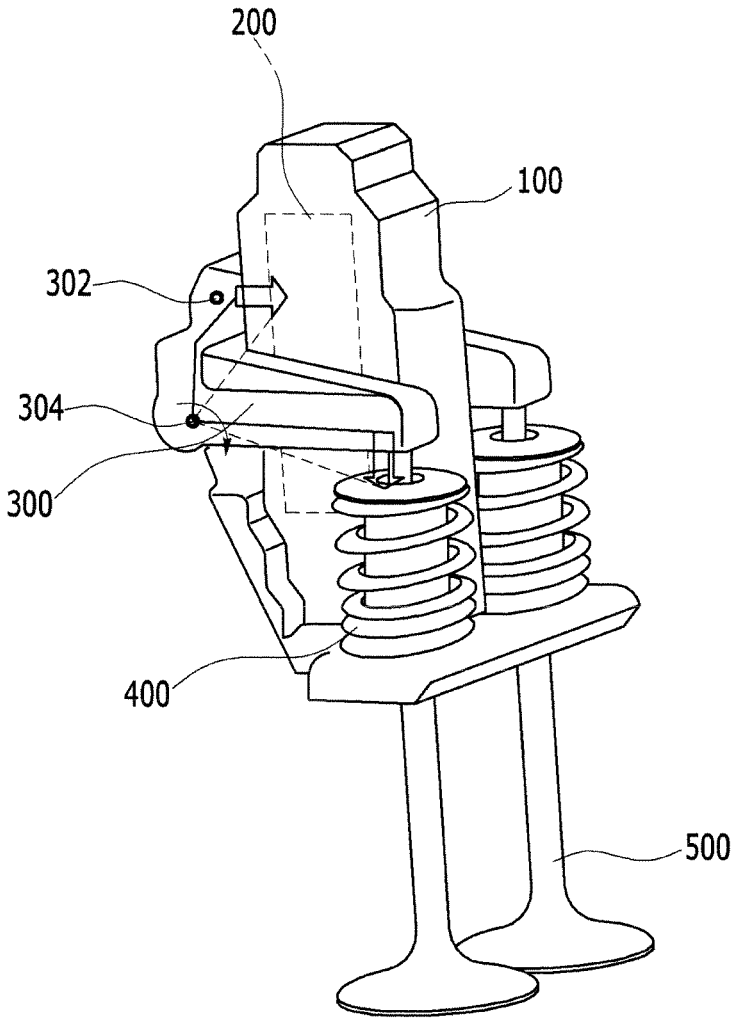
FIG. 1 is a perspective view illustrating a valve driving device using a piezoelectric actuator according to an exemplary embodiment of the present inventive concept.

Hereinafter, the present inventive concept will be described more fully hereinafter with reference to the accompanying drawings, in which exemplary embodiments of the invention are shown. As those skilled in the art would realize, the described embodiments may be modified in various different ways, all without departing from the spirit or scope of the present inventive concept.

In addition, unless explicitly described to the contrary, the word "comprise" and variations such as "comprises" or "comprising" will be understood to imply the inclusion of stated elements but not the exclusion of any other elements.

Like reference numerals designate like constituent elements throughout the specification.

FIG. 1 is a perspective view illustrating a valve driving device using a piezoelectric actuator according to an exemplary embodiment of the present inventive concept.

As illustrated in FIG. 1, a valve driving device using a piezoelectric actuator according to an exemplary embodiment of the present inventive concept includes a piezoelectric body 200 of which a volume expands according to a voltage applied thereto, a displacement increase housing 100 for amplifying the volume expansion of the piezoelectric body 200, and a swing arm 300 connected to the displacement increase housing 100 and operated to drive an engine valve 500 according to the amplified expansion of the piezoelectric body 200.

The piezoelectric body 200 may be coupled with the displacement increase housing 100 which amplifies expansive force of the piezoelectric body 200 when the piezoelectric body 200 expands. Then, the displacement increase housing 100 transmits the amplified force to the swing arm 300 to drive the engine valve 500.

The connection between the piezoelectric body 200 and the displacement increase housing 100, and the connection between the displacement increase housing 100 and the swing arm 300 may be easily made by those skilled in the art through the contents of FIGS. 3 to 6 and an existing mechanism connection technology, so that detailed descriptions thereof will be omitted.

Figure 8:
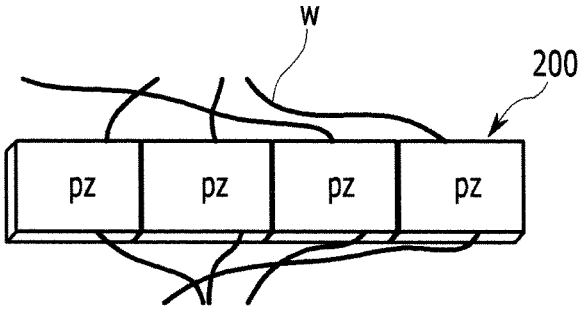
FIG. 8 is a diagram illustrating a stack form of piezoelectric devices according to an exemplary embodiment of the present inventive concept.

The piezoelectric body 200 comprises a predetermined number of piezoelectric devices PZ stacked as illustrated in FIG. 8. The predetermined number of piezoelectric devices PZ may be determined in relation to the driving of the engine valve 500. A driving voltage is applied to each of the piezoelectric devices PZ through a wire W.

The piezoelectric body 200 formed by stacking the plurality of piezoelectric devices PZ serves as a piezoelectric actuator. A voltage applied to the piezoelectric body 200 serving as the piezoelectric actuator may be a high voltage having a valve profile waveform.

In the exemplary embodiment of the present inventive concept, the piezoelectric body 200 comprises the piezoelectric actuator in which the plurality of piezoelectric devices are stacked, but the scope of the present disclosure is not limited thereto. As long as the piezoelectric body 200 has a configuration serving as the piezoelectric actuator, the technical spirit of the present inventive concept is applicable to the piezoelectric body 200 even though the piezoelectric body has a different configuration.

The displacement increase housing 100 perpendicularly expands or contracts with respect to an expansion direction of the piezoelectric body 200 as illustrated in FIGS. 3 to 6.

Figure 3:
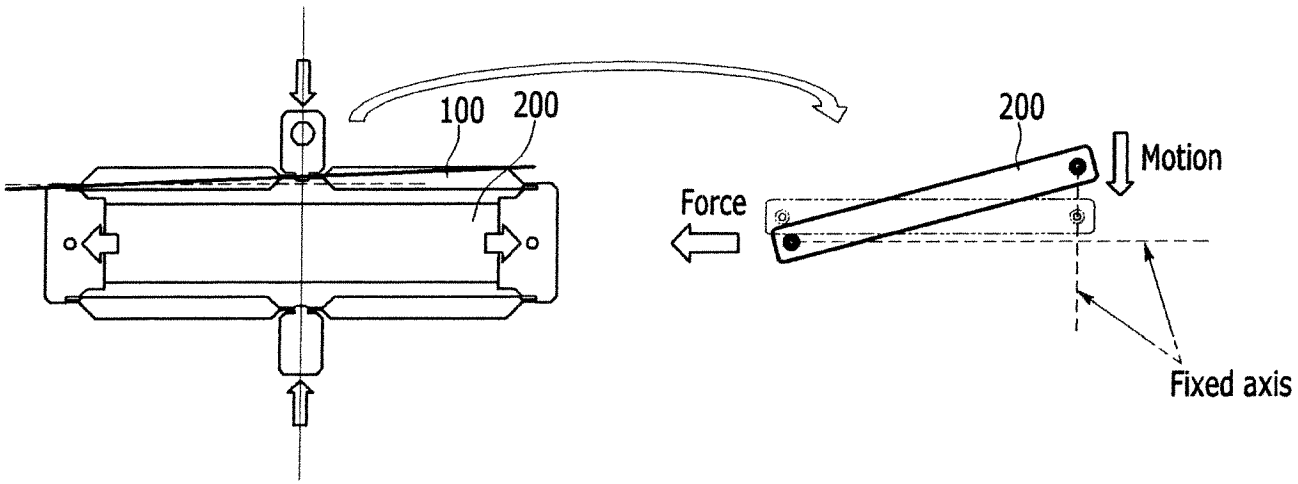
FIG. 3 is a diagram illustrating a contracted form of a displacement increase housing when a piezoelectric body according to an exemplary embodiment of the present inventive concept is expanded.
Figure 4:
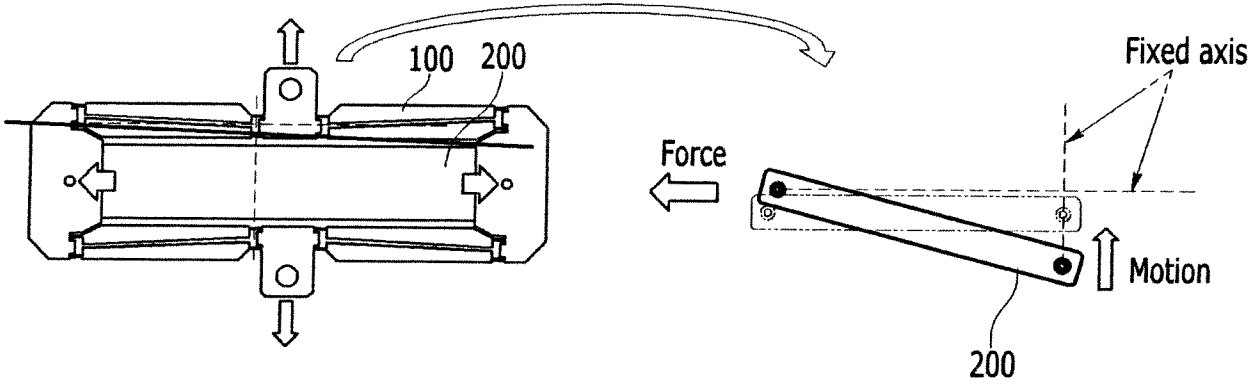
FIG. 4 is a diagram illustrating an expansion form of the displacement increase housing when the piezoelectric body according to the exemplary embodiment of the present inventive concept is expanded.
Figure 5:
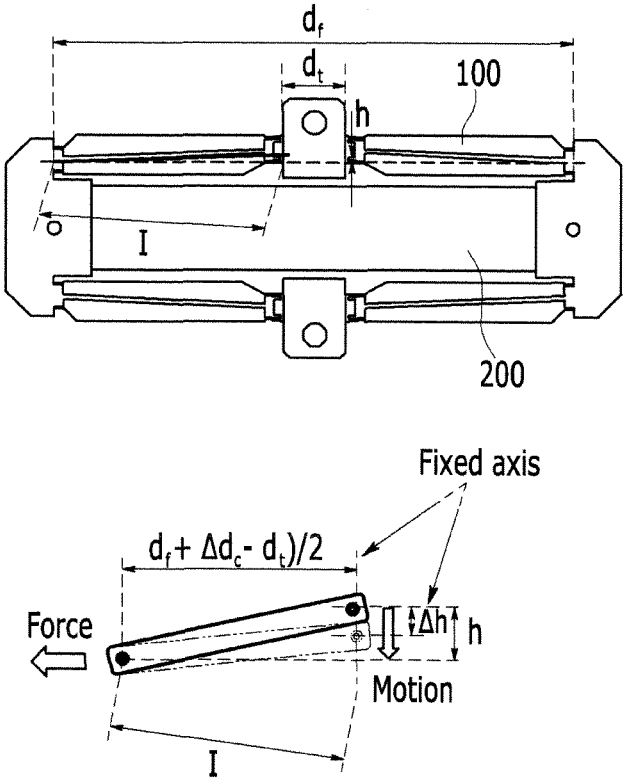
FIG. 5 is a diagram illustrating a contraction displacement of the displacement increase housing according to the exemplary embodiment of the present inventive concept.
Figure 6:
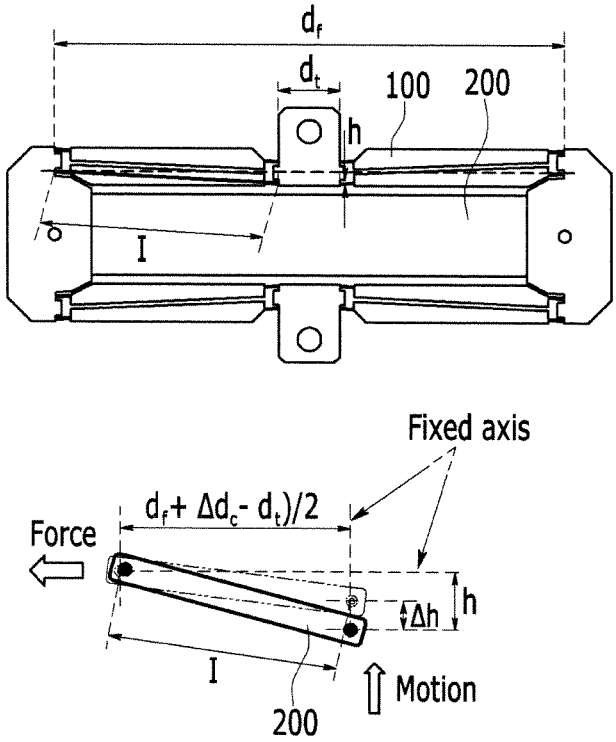
FIG. 6 is a diagram illustrating expansion displacement of the displacement increase housing according to the exemplary embodiment of the present inventive concept.

For example, FIGS. 3 and 5 illustrate the displacement increase housing 100 contracting in a vertical direction shown by the inwardly pointing arrows as the piezoelectric body 200 expands in a horizontal direction shown by outwardly pointing arrows. FIGS. 4 and 6 illustrate the displacement increase housing 100 expanding in the vertical direction in which the dielectric body 200 expands in the horizontal direction.

The valve driving device using the piezoelectric actuator according to the exemplary embodiment of the present inventive concept may include further, as illustrated in FIG. 1, an upper pin 302 for restricting rotation of an upper part of the swing arm 300 and the displacement increase housing 100. A lower pin 304 closely fixes a lower part of the swing arm 300 and the displacement increase housing 100. A valve spring 400 provides elastic restoring force to the engine valve 500.

The upper pin 302 is formed in the form of a pin for restricting the rotation of the upper part of the swing arm 300 and the displacement increase housing 100, but it should be understood that the scope of the present disclosure is not limited thereto. As long as the upper pin 302 has a configuration for restricting the rotation of the upper part of the swing arm 300 and the displacement increase housing 100, the technical spirit of the present inventive concept is applicable to the upper pin 302 even though a pin has a different configuration.

The lower pin 304 closely fixes the lower part of the swing arm 300 and the displacement increase housing 100, but it should be understood that the scope of the present inventive concept is not limited thereto. As long as the lower pin 304 has a configuration for closely fixing the lower part of the swing arm 300 and the displacement increase housing 100, the technical spirit of the present inventive concept is applicable to the lower pin 304 even though a pin has a different configuration.

An existing widely known spring is applicable to the valve spring 400, so that a detailed description of the valve spring 400 will be omitted.

Referring to FIGS. 4 and 6, a displacement h of the displacement increase housing 100 according to an exemplary embodiment of the present inventive concept may be represented by the formula below.

$$\Delta h = h - \{I^2 - [(d_f + \Delta d_c - t_d)/2]^2\}^{1/2}$$

$h = 2\Delta h$ $\Delta h$ (change in incline plane height)

$d_f$ flexure frame(mm)

$d_t$ top part length(mm)

h incline plane height(mm)

I incline plane length(mm)

$\Delta d_c$ change in ceramic length(mm)

In the exemplary embodiment of the present inventive concept, the displacement increase housing 100 expands in a vertical direction as depicted as the piezoelectric body 200 expands, but it should not be understood that the scope of the present disclosure is essentially limited thereto. As long as the displacement increase housing 100 has a configuration for substantially driving the engine valve 500 in association with the expansion of the piezoelectric body 200, the technical spirit of the present disclosure is applicable to the displacement increase housing 100 even if a displacement increase housing has a different configuration.

Figure 9:
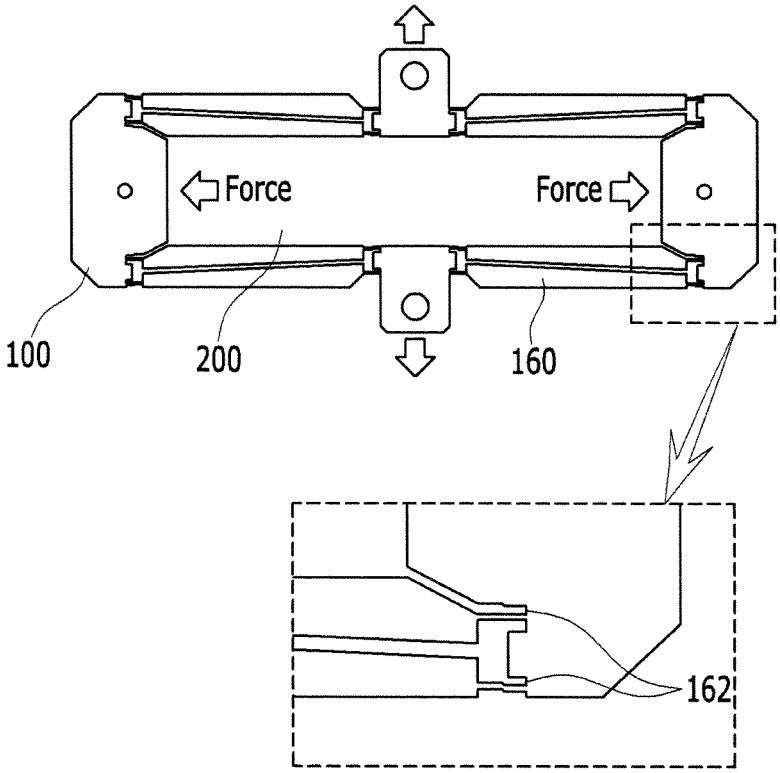
FIG. 9 is a diagram illustrating a dual frame structure and a dual hinge of the displacement increase housing according to the exemplary embodiment of the present inventive concept.

The displacement increase housing 100 may be provided with a dual frame 160 as illustrated in FIG. 9 in order to improve hardness, and the dual frame 160 is operated by a dual hinge 162, thereby improving durability.

Figure 7:
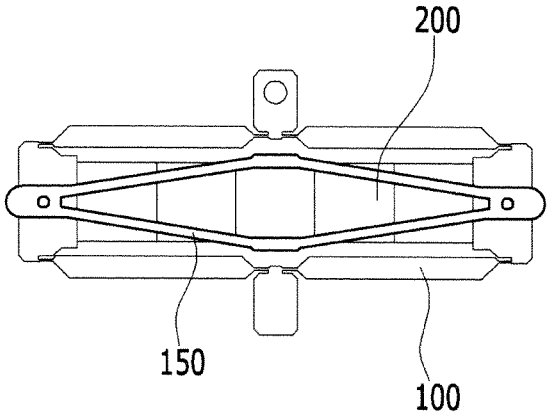
FIG. 7 is a diagram illustrating a coupling form of a preload and the displacement increase housing according to the exemplary embodiment of the present inventive concept.

Referring to FIG. 7, the displacement increase housing 100 may include a preload spring 150. The preload spring 150 restricts the piezoelectric body 200 so that the piezoelectric body 200 sits in the displacement increase housing 100. It is obvious to those skilled in the art that the preload spring 150 may be fixed to the displacement increase housing 100 through the pin and the like.

The preload spring 150 may have a diamond shape as illustrated in FIG. 7, but it should be understood that the scope of the present disclosure is not limited thereto. As long as the preload spring 150 has a configuration in which the displacement increase housing 100 may restrict the piezoelectric body 200, the technical spirit of the present disclosure is applicable to the preload spring 150 even if a preload spring has a different configuration.

Hereinafter, an operation of the valve driving device using the piezoelectric actuator according to the exemplary embodiment of the present inventive concept will be described in detail with reference to the accompanying drawings.

Figure 2:
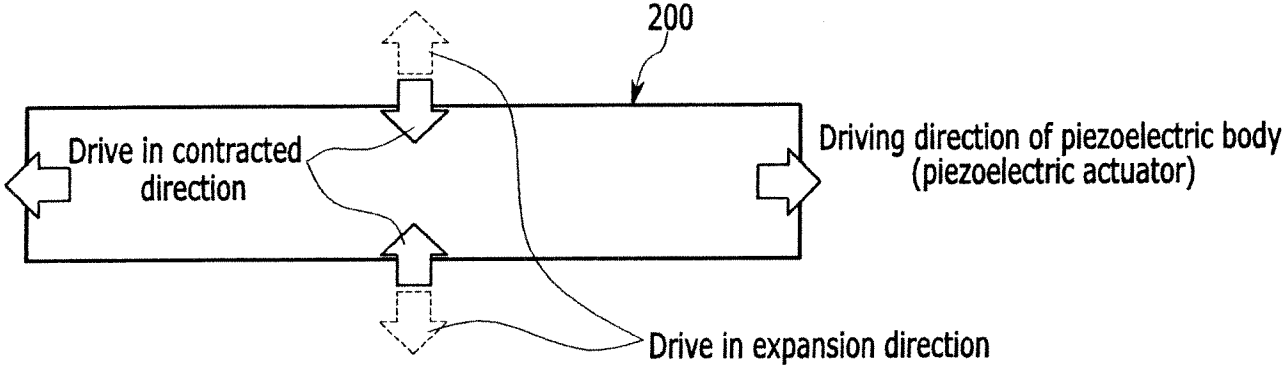
FIG. 2 is a diagram illustrating a driving form of the valve driving device using the piezoelectric actuator according to the exemplary embodiment of the present inventive concept.

FIG. 1, described previously, is a perspective view illustrating a valve driving device using a piezoelectric actuator according to an exemplary embodiment of the present inventive concept, and FIG. 2 is a diagram illustrating an operation form of the valve driving device using the piezoelectric actuator according to the exemplary embodiment of the present inventive concept.

For example, when a valve driving applied voltage is applied to the piezoelectric body 200 in association with the driving of the engine, the piezoelectric body 200 expands in left and right in a horizontal direction of the arrow as illustrated in FIGS. 2 to 6.

When voltage is applied to the piezoelectric body 200 inside the displacement increase housing 100, the piezoelectric body 200 vertically expands. As the piezoelectric body 200 expands as described above, the displacement increase housing 100 contracts as illustrated in FIGS. 3 and 5 or expands as illustrated in FIGS. 4 and 6.

When the displacement increase housing 100 contracts according to the expansion of the piezoelectric body 200 as illustrated in FIGS. 3 and 5, the rotation of an upper part of the swing arm 300 and the displacement increase housing 100 is restricted by, for example, the upper pin 302. A lower part of the swing arm 300 and the displacement increase housing 100 are closely fixed to each other by, for example, the lower pin 304 when the displacement increase housing 100 contracts in a direction of the arrow as illustrated in FIG. 1, so that the swing arm 300 provided at an upper end of the engine valve 500 moves downward in a direction of the arrow based on the lower pin 304 as a rotation axis to press the valve spring 400.

When the swing arm 300 presses the valve spring 400 as described above, the engine valve 500 moves downward to open the valve to allow air out or in.

According to the exemplary embodiment of the present inventive concept, the engine valve is driven by an expanded volume of the piezoelectric body according to voltage applied thereto, and the engine valve opens/closes by amplifying the expansion of the piezoelectric body with the displacement increase housing and the swing arm, thereby improving fuel efficiency and output, reducing exhausted gas, decreasing the number of engine components, to and reducing material cost and weight.

While this inventive concept has been described in association with what is presently considered to be practical exemplary embodiments, it is to be understood that the inventive concept is not limited to the disclosed embodiments, but on the contrary, is intended to cover various modifications and equivalent arrangements included within the spirit and scope of the appended claims.

What is claimed is:

1. A valve driving device using a piezoelectric actuator, comprising:

a piezoelectric body of which a volume expands according to a voltage applied thereto;

a displacement increase housing for amplifying the volume expansion of the piezoelectric body, the displacement increase housing perpendicularly expanding or contracting with respect to an expansion direction of the piezoelectric body; and a swing arm connected to the displacement increase housing and operated to drive an engine valve according to the amplified expansion of the piezoelectric body, wherein the swing arm opens the engine valve when the displacement increase housing perpendicularly contracts, and the swing arm closes the engine valve when the displacement increase housing perpendicularly expands.

2. The valve driving device of claim 1, wherein:

the piezoelectric body is formed by stacking a plurality of piezoelectric devices and serves as the piezoelectric actuator.

3. The valve driving device of claim 1, wherein:

the displacement increase housing expands as the piezoelectric body expands.

4. The valve driving device of claim 3, wherein:

the displacement increase housing expands in a vertical direction as the piezoelectric body expands in a horizontal direction.

5. The valve driving device of claim 1, wherein:

the displacement increase housing contracts as the piezoelectric body expands.

6. The valve driving device of claim 5, wherein:

the displacement increase housing contracts in a vertical direction as the piezoelectric body expands in a horizontal direction.

7. The valve driving device of claim 1, wherein:

the displacement increase housing has a dual frame.

8. The valve driving device of claim 7, wherein:

the dual frame of the displacement increase housing is operated by a dual hinge.

9. The valve driving device of claim 1, wherein:

the displacement increase housing includes a preload spring for restricting the piezoelectric body.

10. The valve driving device of claim 1, wherein:

the piezoelectric body is coupled with the displacement increase housing.

11. The valve driving device of claim 1, further comprising:

an upper pin for restricting rotation of an upper part of the swing arm and the displacement increase housing;

a lower pin fixes a lower part of the swing arm and the displacement increase housing; and a valve spring for providing elastic restoring force to the engine valve.

* * * * *